United States Patent [19]

Yamakawa

[11] 4,430,862

[45] Feb. 14, 1984

[54] INTERNAL COMBUSTION ENGINE FOR VEHICLES

[75] Inventor: Toru Yamakawa, Hachioji, Japan

[73] Assignee: Fuji Jukogyo Kabushiki Kaisha, Tokyo, Japan

[21] Appl. No.: 294,687

[22] Filed: Aug. 20, 1981

[30] Foreign Application Priority Data

| | | | |
|---|---|---|---|
| Aug. 30, 1980 | [JP] | Japan | 55-120247 |
| Sep. 12, 1980 | [JP] | Japan | 55-127700 |
| Sep. 12, 1980 | [JP] | Japan | 55-127701 |

[51] Int. Cl.[3] ..... F02B 73/00

[52] U.S. Cl. ..... 60/718; 60/709

[58] Field of Search ..... 60/709, 711, 718; 440/3; 180/54 C

[56] References Cited

U.S. PATENT DOCUMENTS

| | | | |
|---|---|---|---|
| 2,419,810 | 4/1947 | Beall | 60/709 X |
| 2,527,424 | 10/1950 | Johansson | 60/718 |
| 4,116,006 | 9/1978 | Wallis | 60/718 X |

*Primary Examiner*—Allen M. Ostrager

*Assistant Examiner*—Stephen F. Husar

*Attorney, Agent, or Firm*—Martin A. Farber

[57] ABSTRACT

An internal combustion engine for vehicles comprising a primary and an auxiliary engine unit each comprising vertically disposed cylinders and a crankshaft operatively connected to the respective cylinders. The crankshafts are arranged in parallel. A first output shaft is positioned parallel to both crankshafts and at an intermediate position between extensions of the crankshafts. The auxiliary engine unit is spaced apart from an end of the output shaft defining a space. The cylinders of each engine unit are arranged in staggered disposition. A clutch is disposed in the space between the auxiliary engine unit and the output shaft for transmitting an output of the auxiliary engine unit to the output shaft. A gear train comprises three gears including a first end gear secured to the crankshaft of the primary engine unit, a second end gear secured to an output shaft of the clutch, and an intermediate gear secured to the first output shaft engaging with both end gears. A switch provides for engaging the clutch when engine load exceeds a predetermined value.

14 Claims, 9 Drawing Figures

FIG. 6
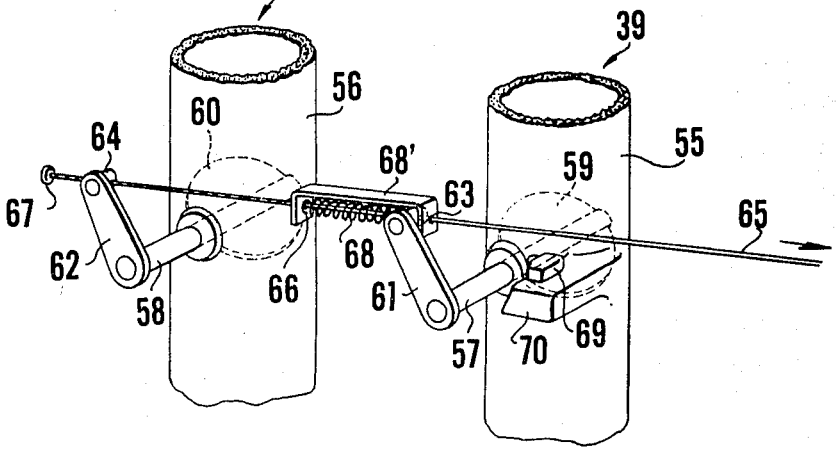
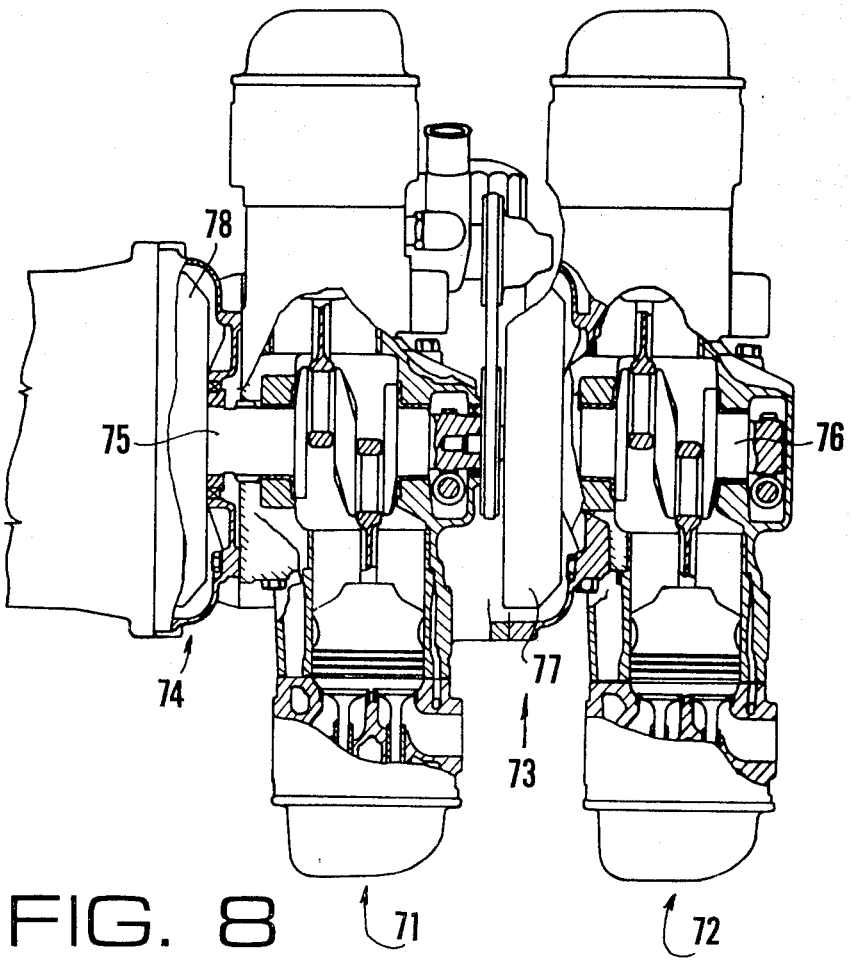
FIG. 8

INTERNAL COMBUSTION ENGINE FOR VEHICLES

BACKGROUND OF THE INVENTION

The present invention relates to a multi-stage internal combustion engine for vehicles comprising two or more power units, which are combined in response to a driving condition of the vehicle for effectively generating power.

FIG. 1 shows a fuel consumption characteristic of a conventional engine at various specific fuel consumptions (g/ps.hr), in which the abscissa is engine speed (r.p.m.), and the ordinate is torque. Curve A shows the running load (resistance) of a vehicle on a flat road. The curve A is determined by the air resistance of the body of the vehicle and the gear ratio of the transmission of the engine and the specific fuel consumption is decided by the performance of the engine. It is desirable to design the engine that the curve A passes through low fuel consumption zones.

FIG. 2 shows a fuel consumption characteristic of an engine according to the present invention comprising two power units. The first zone C is characteristic of the first power unit and the second zone E is characteristic of the engine in which the first power unit and the second power unit are combined. The fuel consumption characteristic of the second zone is the same as that of the conventional engine shown in FIG. 1 and the runnning load curve B is the same as the curve A. If the curve B passes through a minimum fuel consumption zone D at a small torque operation as shown in FIG. 2, fuel consumption is improved.

SUMMARY OF THE INVENTION

The object of the present invention is to provide an engine comprising two or more power units which are combined in accordance with the driving condition of the vehicle powered by the engine, whereby the fuel consumption may be improved.

According to the present invention, there is provided an internal combustion engine for vehicles comprising a plurality of vertically disposed first cylinders and a first crankshaft operatively connected to the first cylinders, an auxiliary engine unit comprising a plurality of vertically disposed second cylinders and a second crankshaft operatively connected to the second cylinders. The first and second crankshafts of the engine units are arranged in parallel. A first output shaft is positioned on a line which is parallel to both the first and second crankshafts between extensions of both crankshafts. The auxiliary engine unit is spaced from an end of the output shaft relative to that of the primary engine unit, and defines a space between the auxiliary engine unit and the output shaft. The second cylinders are arranged in staggered disposition relative to the first cylinders of the primary engine unit. A clutch is disposed in the space between the auxiliary engine unit and the output shaft for transmitting an output of the auxiliary engine unit to the output shaft when the clutch is engaged. A gear train comprises three gears including end gears respectively secured to the crankshafts of the engine units, and an intermediate gear secured to the first output shaft and engaging with the end gears, means for engaging the clutch when the engine load exceeds a predetermined value.

BRIEF DESCRIPTION OF DRAWINGS

FIG. 6 is a schematic perspective view of a carburetor;

FIG. 8 is a plan view showing a second embodiment of the present invention.

DETAILED DESCRIPTION OF THE PREFERRED EMBODIMENTS

Figure 3:
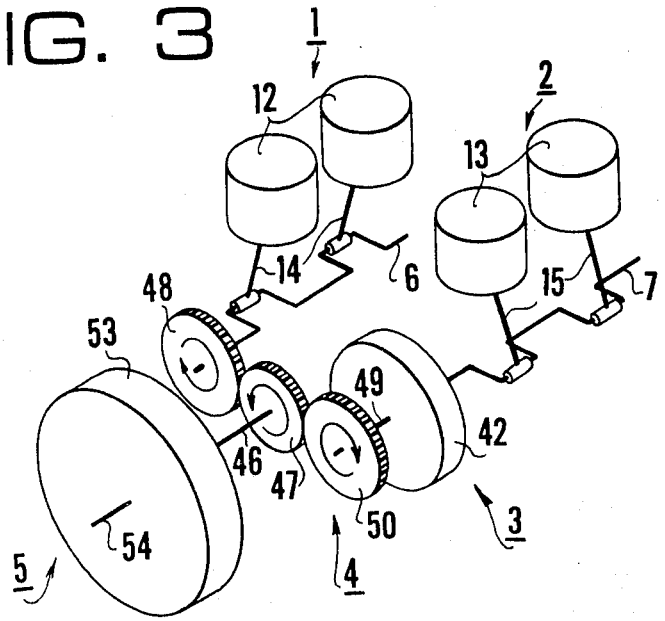
FIG. 3 is a schematic perspective view of an engine according to the present invention.
Figure 4:
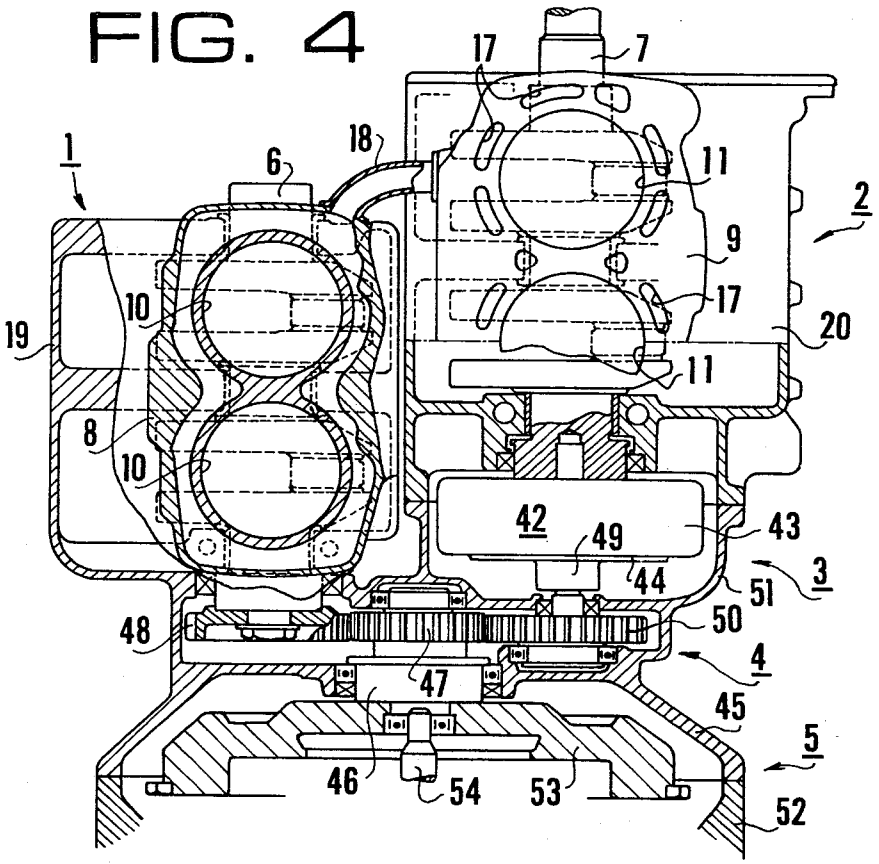
FIG. 4 is a plan view of the engine shown partly in section.
Figure 5:
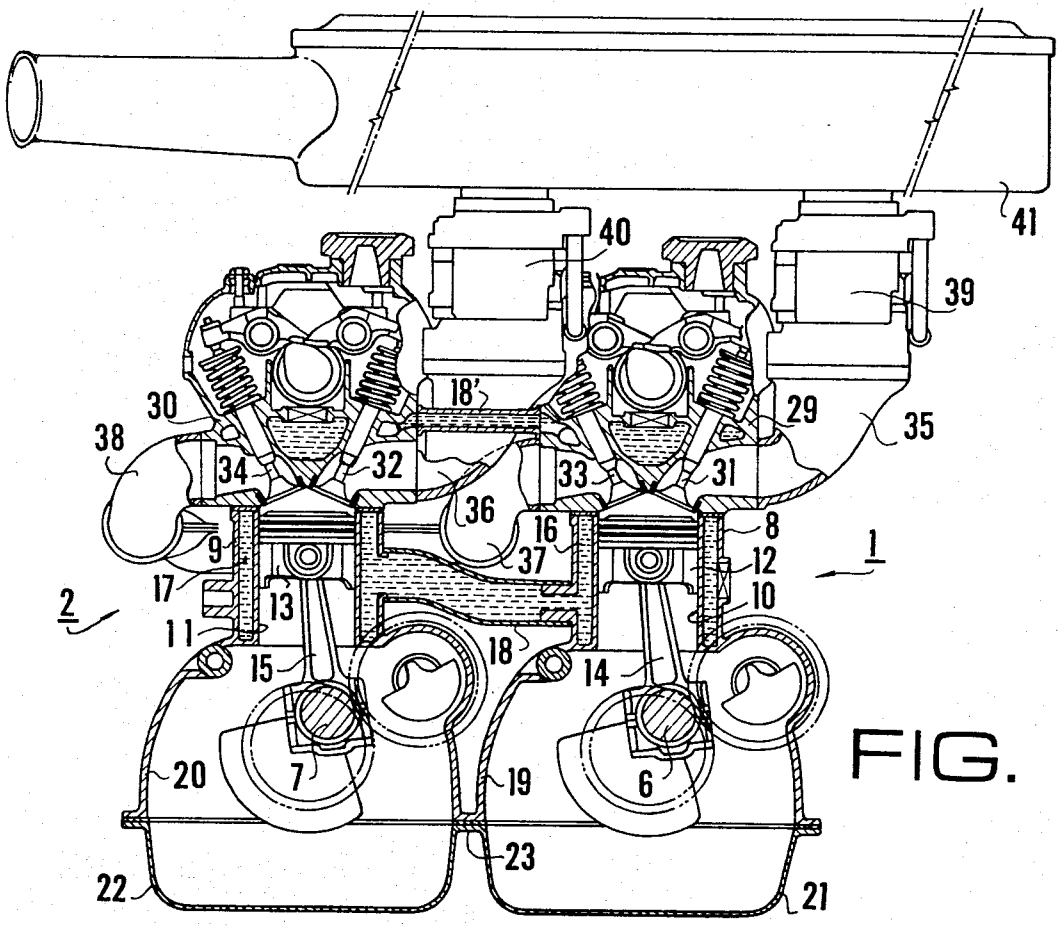
FIG. 5 is a sectional front view of the engine shown partially in section.

Referring to FIGS. 3 to 5, the engine comprises a first power unit (primary engine unit) 1, a second power unit (auxiliary engine unit) 2, a clutch portion 3, an output shaft portion 4 and a flywheel portion 5. Each of power units 1 and 2 comprises an independent two-cylinder engine having an independent ignition system. The power unit 1 comprises a cylinder block 8, a pair of vertical cylinders 10, a pair of pistons 12 connected to a crankshaft 6 by connecting rods 14, and the power unit 2 comprises a cylinder block 9, a pair of vertical cylinders 11 provided with pistons 13 connected to a crankshaft 7 by connecting rods 15. Crankcases 19 and 20, oil pans 21 and 22, cylinder heads 29 and 30, exhaust valves 33 and 34, exhaust pipes 37 and 38, inlet valves 31 and 32, inlet pipes 35 and 36, and carburetors 39 and 40 are provided in both power units, respectively. A common air cleaner 41 is provided communicating with the carburetors 39 and 40.

The cooling water system of the engine comprises water jackets 16 and 17 provided in the cylinder blocks 8 and 9 and passages 18 and 18' connecting both water jackets with each other. Cooling water is passed through both water jackets 16 and 17 by a water pump (not shown) which is driven by the first power unit 1. Since the cooling water circulates through both power units, the second power unit 2 is warmed up at the same time as the warming-up of the first power unit 1.

Both oil pans 21 and 22 are communicated with each other by a passage 23 and lubricating oil is passed through both power units.

The clutch portion 3 comprises a clutch disposed in a clutch casing 51 which comprises an electro-magnetic clutch 42 having a drive member 43 secured to the crankshaft 7 of the second power unit 2, and a driven member 44 connected to an output shaft 49 of the clutch.

A gear train comprises three gears namely an end gear 48 secured to the crankshaft 6 and an end gear 50 secured to the output shaft 49. These gears are provided in a gear case 45 and engage with an intermediate gear 47 secured to an output shaft 46. The output shaft 46 is secured to a flywheel 53 in which an input shaft 54 of a transmission (not shown) in a transmission case 52 is rotatably supported. Thus, the engine comprises power units arranged in parrallel which have a small lateral width.

It will be seen from FIG. 4 that the cylinders 10 and 11 are arranged in staggered disposition relative to each other so that the cylinder block 9 and the crankcase 20 of the second power unit 2 are disposed longitudinally apart from the flywheel portion 5 to provide a space for the clutch portion 3.

Referring to FIG. 6 carburetors 39 and 40 comprise barrels 55 and 56, throttle valves 59 and 60 supported by throttle shafts 57 and 58, respectively. Levers 61 and 62 secured to throttle shafts 57, 58 have pins 63 and 64 having holes, respectively, through which an accelerator wire 65 passes. Engaging members 66 and 67 are fixed to the accelerator wire 65. A compression spring 68 is provided between the pin 63 and the engaging member 66, and a frame 68' is slidably engaged with the wire 65 at opposite sides of the member 66 and the pin 63. A microswitch 69 is provided on a support 70 so as to be operated by the lever 61.

In operation, when starting of the engine, the eletromagnetic clutch 42 is disengaged. Thus, only the first power unit 1 is started by a starter (not shown) through the flywheel 53, gears 47, 48 and crankshaft 6.

During small engine torque operation, the electromagnetic clutch 42 is disengaged and the first power unit is operated. In such a low torque operation, the fuel consumption characteristic is shown by the first zone C and the running load curve B passes through the minimum fuel consumption zone D. Thus, fuel consumption of the engine is low.

Figure 7:
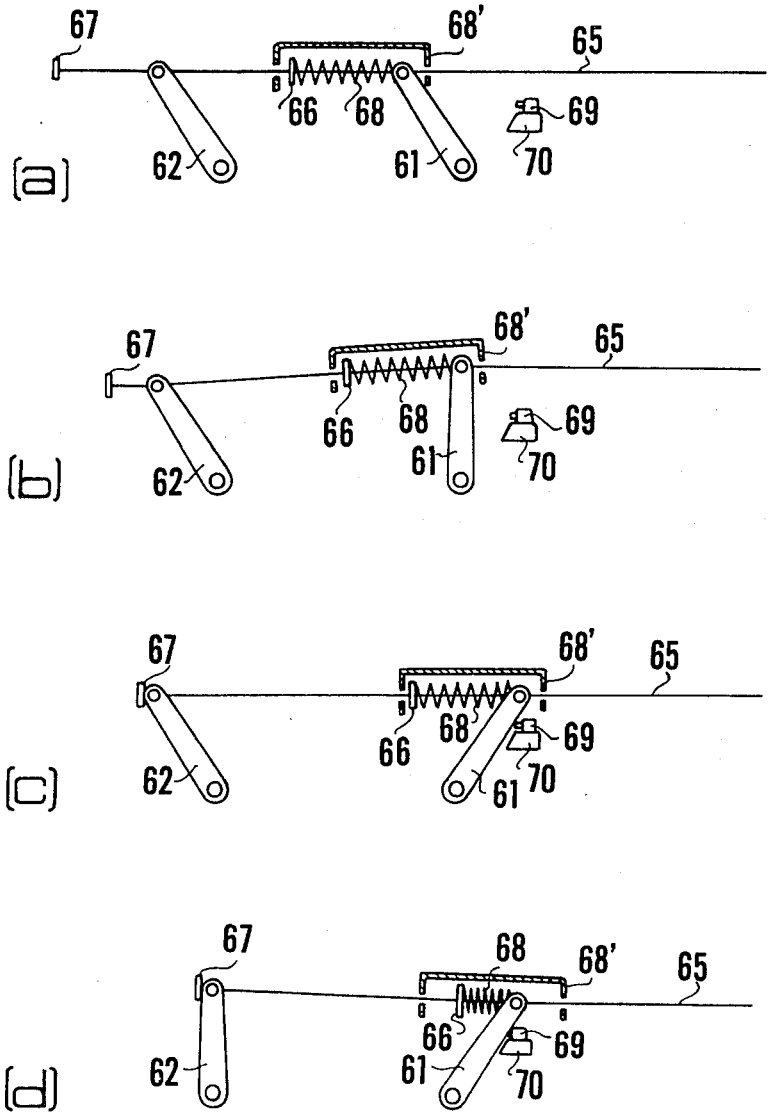
FIG. 7 (*a*) to (*d*) are schematic illustrations showing the operation of the carburetor.

When the accelerator pedal is depressed, the accelerator wire 65 moves to the right in FIG. 7(*a*). Since the engaging member 66 engages with the lever 61 through the spring 68 and the engaging member 67 does not engage with the lever 62, only the first power unit 1 is accelerated or decelerated (FIG. 7(*b*).

Figure 1:
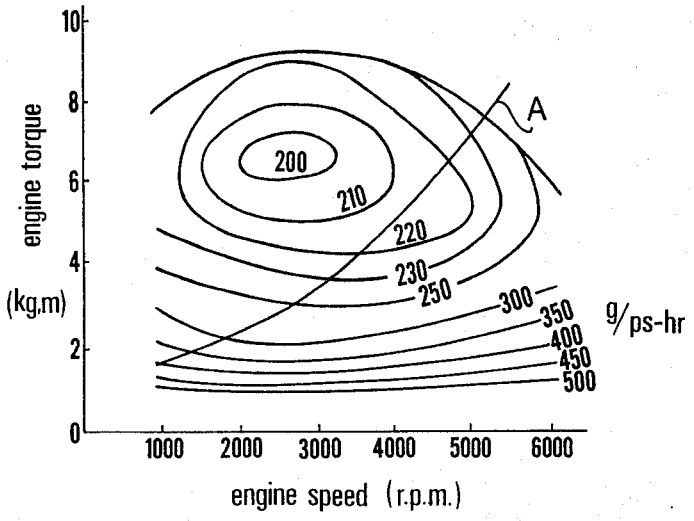
FIG. 1 is a graph showing a fuel consumption characteristic of a conventional engine.
Figure 2:
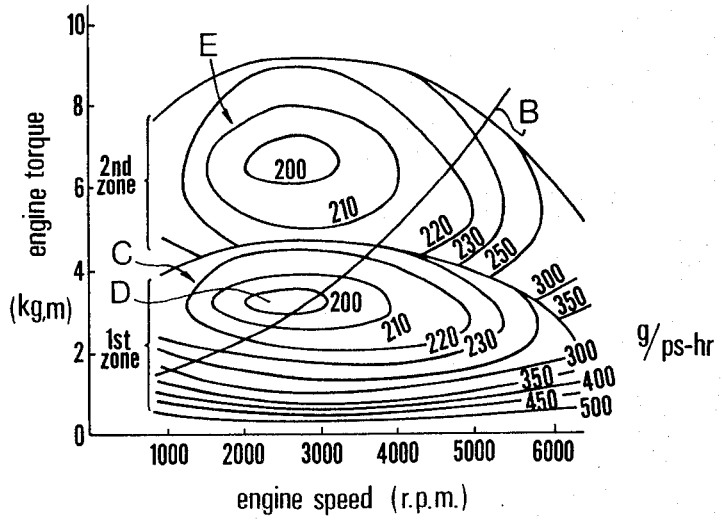
FIG. 2 is a graph showing a fuel consumption characteristic of an engine of the present invention;.

In a large engine torque operation, the accelerator pedal is deeply depressed, so that the lever 61 actuates the microswitch 69 (FIG. 7(*c*)) to close the circuit of the electromagnetic clutch 42 to energize it. At the same time, the ignition system of the second power unit 2 is operated by the closing of the microswith 69. Thus, the electromagnetic clutch 42 is engaged, so that the shaft 49 is coupled to the crankshaft 7 of the second power unit 2 and the pistons 13 of the second power unit 2 are driven by the first power unit 1, causing starting of the second power unit 2. At that time, the throttle valve 59 is at a position immediately before the full open position. Thereafter, the lever 61 abuts the support 70 and the engaging member 67 engages the lever 6. When the accelerator pedal is further depressed, the spring 68 is compressed by the engaging member 66 and the lever 62 is rotated by the engaging member 67 as shown in FIG. 7(*d*). Thus, the second power unit 2 is accelerated, so that composite power of the first and second power units is produced. In such an operation, the running load curve B passes through the second zone E in FIG. 2.

When the accelerator pedal is released, the accelerator wire 65 moves to the left in FIG. 7, so that the lever 62 rotates in the counterclockwise direction and then the lever 61 also rotates in the same direction. Thus, the microswitch 69 is opened, the electromagnetic clutch 42 is disengaged, and only the first power unit 1 is operated.

FIG. 8 shows the second embodiment of the present invention. The engine comprises two units of opposed-cylinder type two-cylinder engine. Both units are connected in series. The engine consists of a first power unit 71, second power unit 72, clutch portion 73, and output shaft portion 74. Crankshafts 75 and 76 of both power units 71 and 72 are connected by an electromagnetic clutch 77. The flywheel 78 is connected to the crankshaft 75.

In a small torque operation, only the first power unit 71 is operated at a low fuel consumption. In a large torque operation, the first and second power units 71 and 72 are connected by the electromagnetic clutch 77.

Although the above described engine comprises two power units, a plurality of stages of power units of more than two units can be arranged into an engine in accordance with the present invention.

Figure 9:
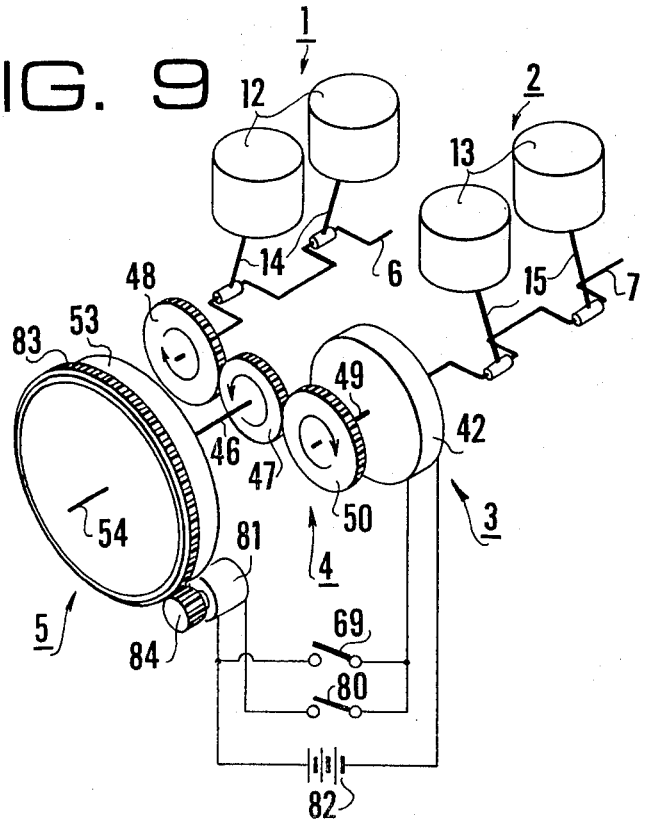
FIG. 9 is a perspective view showing a third embodiment of the present invention.

Referring to FIG. 9 showing a third embodiment, the electromagnetic clutch 42, a starting switch 80, a starting motor 81, and a battary 82 are connected in series. Accordingly, when the starting switch 80 is closed, the electromagnetic clutch 42 is energized to be engaged. A pinion 84 of the starting motor 81 engages with a ring gear 83 of the flywheel 53. Thus, both power units 1 and 2 are started by closing the starting switch 80. Although the electromagnetic clutch 42 is disengaged when the starting switch 80 is opened after the starting of the engine, the second power unit 2 operates in the idling condition.

When the microswitch 69 is closed in a large engine torque condition, the electromagnetic clutch 42 is engaged, and both the first and seond power units are coupled.

In accordance with the third embodiment, since the second power unit 2 always operates during the operation of the engine, the composite power may be obtained without any delay since starting of the second power unit 2 is no longer necessary.

What is claimed is:

1. An internal combustion engine for vehicles comprising a primary engine unit comprising a plurality of vertically disposed first cylinders and a first crankshaft operatively connected to said first cylinders, an auxiliary engine unit comprising a plurality of vertically disposed second cylinders and a second crankshaft operatively connected to said second cylinders, said first and second crankshafts of said engine units being arranged in parallel, a first output shaft positioned on a line which is parallel to both said first and second crankshafts and at an intermediate position between extensions of both said first and second crankshafts, said auxiliary engine unit being spaced apart from an end of said output shaft relative to that of said primary engine unit, and defining a space between said auxiliary engine unit and said output shaft, such that said second cylinders of said auxiliary engine unit are arranged in staggered disposition relative to said first cylinders of said primary engine unit, clutch means disposed in said space between said auxiliary engine unit and said output shaft for transmitting an output of said auxiliary engine unit to said first output shaft when said clutch means is engaged, said clutch means having a second output shaft, a gear train comprising three gears including a first end gear being secured to said first crankshaft of said primary engine unit, a second end gear secured to said second output shaft of said clutch means, and an intermediate gear secured to said first output shaft and engaging with said first and second end gears, and means for engaging said clutch means when engine load exceeds a predetermined value.

2. The internal combustion engine for vehicles according to claim 6 wherein said clutch means is an electromagnetic clutch.

3. The internal combustion engine for vehicles according to claim 2 wherein said engaging means comprises, a switch means for being operated when the engine load exceeds said predetermined value, and circuit means for connecting said electromagnetic clutch to a battery through said switch means.

4. The internal combustion engine for vehicles according to claim 3 wherein said circuit means further includes a starting switch operatively connected between said electromagnetic clutch and said battery.

5. The internal combustion engine according to claim 3, wherein said switch means is a microswitch.

6. The internal combustion engine according to claim 4, further comprising a starting motor connected between said starting switch and said battery.

7. The internal combustion engine according to claim 6, wherein said starting motor is operatively connected to said first output shaft.

8. The internal combustion engine according to claim 7, further comprising a flywheel secured to said first output shaft, said flywheel is formed with a ring gear on its periphery, said starting motor has a pinion engaging said ring gear.

9. The internal combustion engine according to claim 1, wherein said three gears are disposed substantially coplanar and engage peripherally with one another such that said end gears rotate simultaneously in a common rotational direction.

10. The internal combustion engine according to claim 1, wherein said primary engine unit has a carburetor including a first throttle valve, said secondary engine unit has a carburetor including a second throttle valve, a first lever is jointly pivotally connected to said first throttle valve, a second lever is jointly pivotally connected to said second throttle valve, projections are secured to free end regions of said levers, respectively, said projections are each formed with a recess, an accelerator wire, adapted to be connected to an accelerator pedal, extends through said recesses and has first and second engaging members secured thereto adjacent said projections, a coil spring is mounted on said accelerator wire between said first engaging member and said projections, a stationarily mounted switch means, constituting said means for engaging said clutch means, located in a pivot range of said first lever being actuated by means of said first lever so as to cause said clutch means to engage when said accelerator wire is moved a predetermined degree in a first direction corresponding to a predetermined depression of the accelerator pedal so as to pivot said first lever a predetermined amount via said spring and said first engaging member, said second engaging member being located on said accelerator wire so as to initially pivotally act on said second lever when said accelerator wire is moved in said first direction beyond said predetermined degree.

11. The internal combustion engine according to claim 10, further comprising abutment means for limiting pivoting of said first lever at a substantially full open position of said first throttle valve when said accelerator wire is moved in said first direction beyond said predetermined degree.

12. The internal combustion engine accordingto claim 11, wherein said throttle valves are substantially in parallel in an idle condition of both said engine units and said levers are substantially in parallel in the idle condition of both said engine units.

13. The internal combustion engine according to claim 10, wherein said first lever actuates said switch means at substantially a full open position of said first throttle valve corresponding to said predetermined depression of the accelerator pedal and simultaneously said second lever begins to be pivoted by said second engaging member so as to operate said auxiliary engine unit.

14. The internal combustion engine according to claim 1, wherein said cylinders of each of said engine units are longitudinally arranged.

* * * * *